US006527674B1

(12) United States Patent
Clem

(10) Patent No.: US 6,527,674 B1
(45) Date of Patent: Mar. 4, 2003

(54) INTERACTIVE PROGRAMMABLE FITNESS INTERFACE SYSTEM

(75) Inventor: William Clem, Bozeman, MT (US)

(73) Assignee: Conetex, Inc., Elverson, PA (US)

( * ) Notice: Subject to any disclaimer, the term of this patent is extended or adjusted under 35 U.S.C. 154(b) by 0 days.

(21) Appl. No.: 09/590,079

(22) Filed: Jun. 8, 2000

Related U.S. Application Data

(63) Continuation-in-part of application No. 09/156,336, filed on Sep. 18, 1998, now Pat. No. 6,053,844, which is a continuation-in-part of application No. 09/448,954, filed on Nov. 24, 1999.

(51) Int. Cl.[7] ..... A63B 21/00
(52) U.S. Cl. ..... 482/8; 482/9; 482/900
(58) Field of Search ..... 482/1–9, 51, 54, 482/57, 900–902

(56) References Cited

U.S. PATENT DOCUMENTS 6,171,218 B1 1/2001 Shea
6,193,631 B1 * 2/2001 Hickman ..... 482/8
6,330,426 B2 12/2001 Brown et al.

OTHER PUBLICATIONS

Netpulse Communications, Inc., "24 Hour Fitness Partners with Netpulse", Mar. 9, 1998.
Netpulse Communications, Inc., "Netpulse Makes Working Out More Than A Calorie–Burning Session," Mar. 21, 1998.

* cited by examiner

*Primary Examiner*—Glenn E. Richman
(74) *Attorney, Agent, or Firm*—Morgan, Lewis & Bockius, LLP

(57) ABSTRACT

A personalized training system, and a method of fitness training, are disclosed. The personalized training system includes a fitness device, into which a user enters a first plurality of user information, including a choice of an automated interactive learned program mode or an automated fitness test mode, an automated control location that receives the first plurality of user information, and a second plurality of user information during each use of the fitness device by the user, a performance assessor that assesses a performance of the user during each use of a plurality of uses based on a comparison of the second plurality of user information to the first plurality, a performance database incrementally formed by at least the plurality of performance assessments, and a fitness comparator that adjusts the use based on a comparison of the performance database to the second plurality. The method includes entering by a user a first plurality of user information, including a choosing of an automated interactive learned program mode or an automated fitness test mode, providing an automated control location, receiving the first plurality of user information at the automated control location, monitoring a second plurality of user information during each use of the fitness device by the user, performing an assessment of a performance of said user during each use of a plurality of uses, based on a comparing of the second plurality of user information to the first plurality, incrementally generating, over the plurality of uses, a performance database, and adjusting the use based on a comparing of the performance database to the second plurality.

23 Claims, 6 Drawing Sheets

INTERACTIVE PROGRAMMABLE FITNESS INTERFACE SYSTEM

CROSS REFERENCE TO RELATED APPLICATIONS

This application is a divisional application of U.S. patent application Ser. No. 09/590,079, filed on Jun. 8, 2000, which is a continuation in part of U.S. patent application Ser. No. 09/448,954, filed on Nov. 24, 1999, which is a continuation in part of U.S. patent application Ser. No. 09/156,336, filed on 09/18/1998, now U.S. Pat. No. 6,053,844, issued on Apr. 25, 2000, all of which are herein incorporated by reference in their entirety.

FIELD OF THE INVENTION

This invention relates to fitness equipment and, in particular, to control of programmable fitness equipment.

BACKGROUND OF THE INVENTION

Modem fitness machines, or exercise machines, including treadmills, steppers, stationary bicycles, and the like are often electronically controlled to vary their resistance levels. For example, stationary bicycles can be electronically controlled to vary their resistance over the duration of an exercise routine to simulate uphill, level and downhill riding conditions. This helps to prevent the user of the apparatus from becoming bored with an otherwise repetitive exercise.

It is also known for exercise machines to measure the heart rate or pulse rate of the user and to adjust the level of exercise accordingly. This helps to maximize the cardiovascular benefits achieved from the exercise without wasting time and effort. It also provides the benefit of quickly detecting dangerously high or accelerating heart rates. Additionally, pulse detection circuitry has been coupled to exercise equipment to provide to the user with a display of the user heart rate. The user can also manually adjust the resistance level according to the display in order to adjust the heart rate as needed.

It is also known to provide a microprocessor within exercise equipment in order to vary the incline of a treadmill or to vary the resistance to the pedaling of a stationary bicycle according to a stored program in order to achieve target heart rates, for example. It is also known to use a stored program to increase the resistance within exercise equipment in order to increase the user heart rate and to decrease the resistance in order to decrease the heart rate accordingly.

Several types of exercise equipment have more than one variable resistance mechanism to affect the user heart rate. For example, conventional treadmills have both variable inclines and variable speeds. Many stationary bicycles have variable pedal resistance for the lower body as well as variable resistance-based exercise mechanisms for the upper body. Since numerous mechanisms of this type are often intended to be operated simultaneously, the resulting heart rate depends on the resistance of all the variable resistance mechanisms and their relationship to each other.

Furthermore, the conditioning of the skeletal muscle groups being exercised by the user depends on which resistance mechanisms are varied. When exercise equipment having interrelated resistance mechanisms varies only a single resistance mechanism to control heart rate the results can be unsatisfactory because achieving a target heart rate in such equipment by merely increasing or decreasing one of the resistance mechanisms does not consider and compensate for the benefits or detriments that may occur by varying the resistance of the other such mechanisms in relation thereto. However, the known devices do not provide the ability to conveniently alter the control programs within the exercise equipment or to communicate with others regarding control of the exercise equipment during a work out.

SUMMARY OF THE INVENTION

The present invention is directed to a personalized training system. The personalized training system includes a fitness device, into which a user enters a first plurality of user information, which first plurality includes a choice of an automated interactive learned program mode or an automated fitness test mode, an automated control location that is remotely connected to the fitness device through a communicative connection, which automated control location receives the first plurality of user information, and a second plurality of user information during each use of the fitness device by the user, a performance assessor resident at the automated control location, which performance assessor assesses a performance of the user during each use of a plurality of uses based on a comparison of the second plurality of user information to the first plurality, a performance database incrementally formed by at least the plurality of performance assessments, and a fitness comparator that adjusts the use based on a comparison of the performance database to the second plurality.

The present invention is also directed to a method of fitness training. The method includes entering by a user a first plurality of user information, which first plurality includes choosing an automated interactive learned program mode or an automated fitness test mode, providing an automated control location that is remotely connected to the fitness device through a communicative connection, receiving the first plurality of user information at the automated control location, monitoring a second plurality of user information during each use of the fitness device by the user, performing, at the automated control location, an assessment of a performance of said user during each use of a plurality of uses, based on a comparing of the second plurality of user information to the first plurality, incrementally generating, over the plurality of uses, a performance database including at least the plurality of performance assessments, and adjusting the use based on a comparing of the performance database to the second plurality.

The present invention solves problems experienced in the prior art by providing the ability to conveniently and remotely alter the control programs within an exercise environment, and to communicate with other persons and automated systems regarding control of the exercise equipment during a work out. These and other advantages will be apparent from the detailed description of the invention hereinbelow.

DETAILED DESCRIPTION OF THE PREFERRED EMBODIMENT

It is to be understood that the figures and descriptions of the present invention have been simplified to illustrate elements that are relevant for a clear understanding of the present invention, while eliminating, for purposes of clarity, many other elements found in a typical fitness system. Those of ordinary skill in the art will recognize other elements which are necessary and/or desirable for implementing the present invention. However, because such elements are well known in the art, and because they do not facilitate a better understanding of the present invention, a discussion of such elements is not provided herein.

Figure 1:
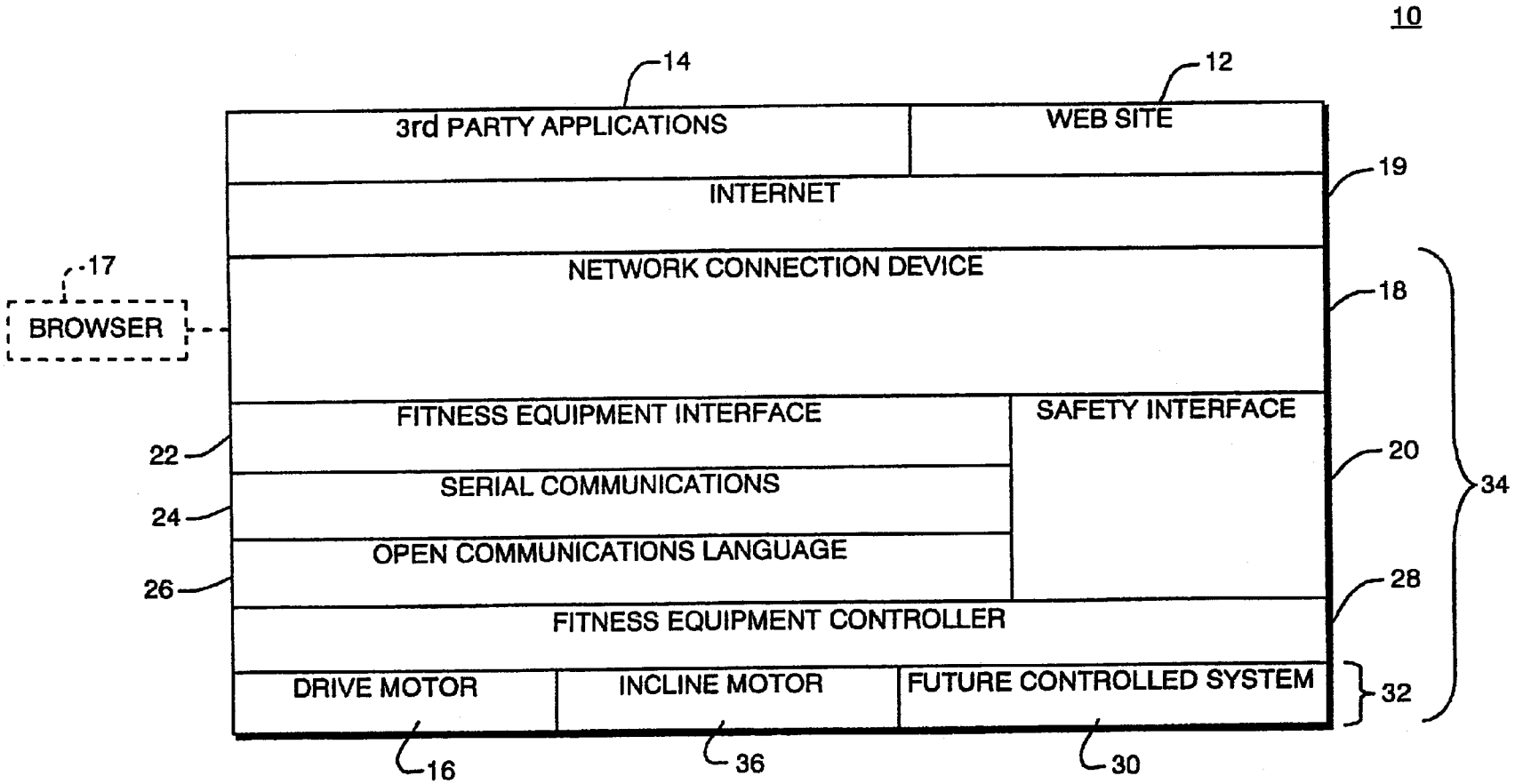
FIG. 1 shows a schematic representation of the interactive programmable fitness system of the present invention.

Referring now to FIG. 1, there is shown a schematic representation of the interactive programmable fitness system 10 of the present invention. The fitness system 10 includes a programmable fitness device 32 interactively coupled with an automated control location 12. The automated control location 12 may be, for example, an internet web site. The fitness device 32 is disposed at a user location 34 geographically remote from the automated control location 12. The interactive communicative coupling between the fitness device 32 and the web site 12 can be by way of an internet system 19. The interactive coupling permits the fitness device 32 to transmit various kinds of user location information to the web site 12. It also permits the web site 12 to transmit control information to the user location 34 to control, for example, drive motor 16 and incline motor 36 of exercise device 32. Thus the web site 12 can operate as a server device for the user. Information can be transmitted between the fitness device 32 and the web site 12 at any time, including immediately prior to an exercise session using fitness device 32 and during such an exercise session.

Using the fitness system 10, a user at a user location 34 can interact online with a live fitness expert located at the web site 12 to engage in a real time two way communication regarding matters related to fitness, including matters such as exercise routines and exercise equipment. For example, the user can obtain advice on modifying an exercise routine as well as technical support information for various kinds of exercise equipment. In addition to interacting, including conversing, with a live fitness expert, a user of the fitness system 10 at the user location 34 can interactively obtain the control information from a computer located at the web site 12. The communication can include the uploading and downloading of video and audio information.

The control information transmitted from the web site 12 can include control signals for directly controlling the fitness device 32. In a preferred embodiment of the fitness system 10 the control information from the web site 12 can be a fitness equipment control program for execution by the controller 28 of the fitness device 32. In this preferred embodiment the controller 28 provides the control signals required for controlling motors 16, 36 according to the control program received from the web site 12. Additionally, a digest of information for each user of fitness system 10 can be accumulated by the web site 12 and the control information can be determined according to the digest as well as the current user location information. For example, the web site can store a plurality of control programs and select a control program from the plurality according to the digest and the current user location information.

Although user location information includes both user and location information, it will be understood that the user location information at the web site 12 can be associated with the actual user rather than any particular geographic location. For example, user location information may, in some embodiments, include the identity, profile, and physical characteristics of each particular user. In this way the user can use fitness system 10 from any location or piece of exercise equipment.

In one embodiment, the user location 34 can interact with the web site 12 in the form of an interactive programmable fitness trainer. The receipt of information at the web site 12, or at an alternate control location 12, is used by the automated control location 12 to provide a personalized training system. The automated remote control location 12 records information from and about the user 34 before the first use, and before and/or during the first and each subsequent use. This first plurality of information may include, for example, a set of fitness goals for the user, at least one parameter, and includes all information entered by the user. The parameters may include the age, weight, sex, height, and medical conditions of the user.

The automated remote control location 12 also preferably has stored thereon general fitness information, in the form of a health database, as to diet, dietary needs, exercise routines, and diet and exercise results. This general information may be gathered by the automated remote control location 12 automatically from the web, by an automated web search, for example, or may be entered by one or more fitness, diet, and exercise experts onto the web site 12.

Figure 1A:
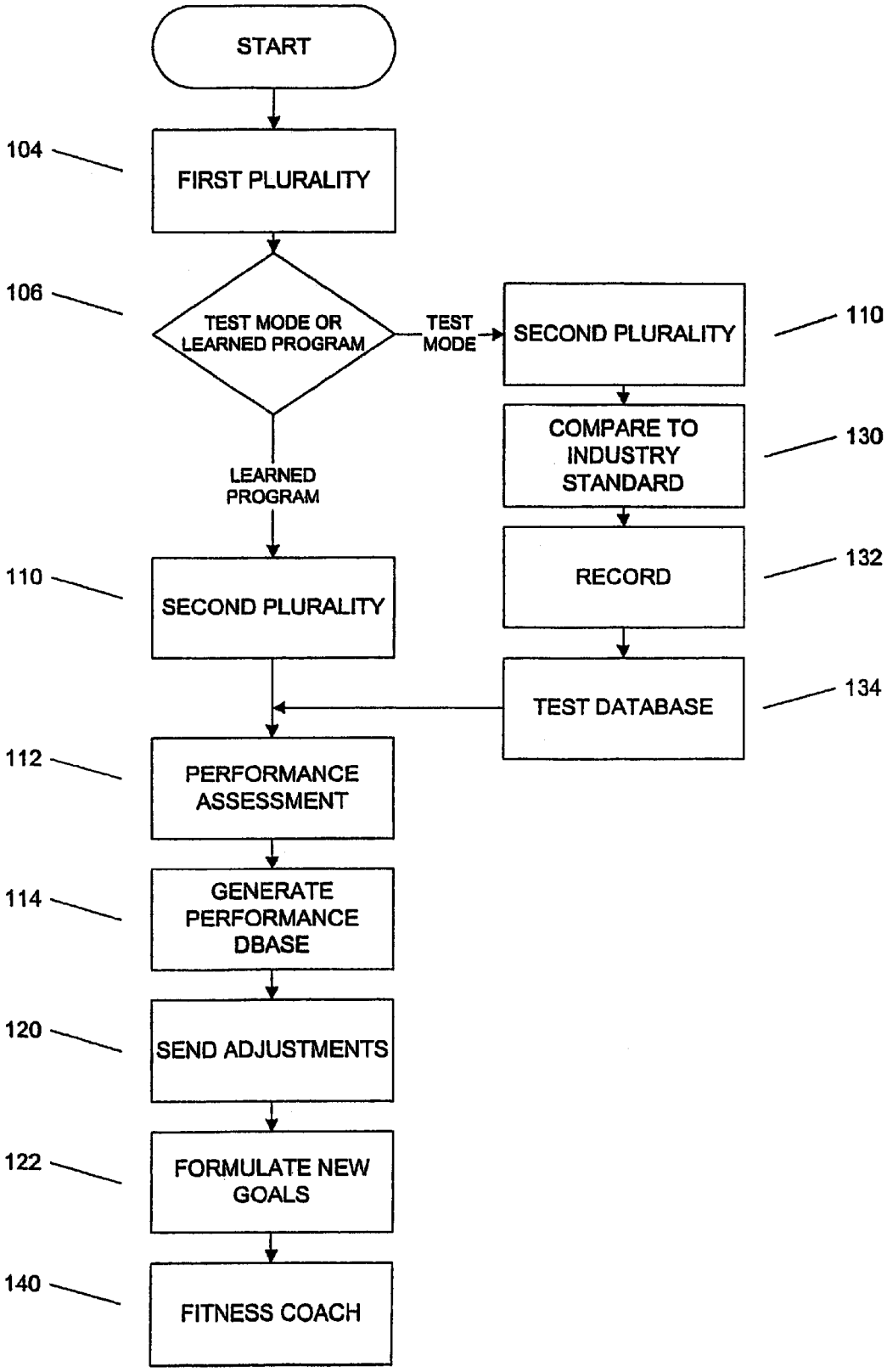
FIG. 1A illustrates s flow diagram of a personal training system.

FIG. 1A illustrates a flow diagram of the personalized training system 10 of the present invention. In one embodiment of the present invention, the user at the user location 34 enters the first plurality of user information to the remote control location 12 through a user interface at the user location 34, at step 104. The first plurality includes a choice made by the user at the fitness device 32 of an automated interactive learned program mode or an automated fitness test mode, at step 106. The automated control location 12 receives the first plurality of user information from the device 32. During each workout, the automated control location also receives a second plurality of user information, either in real time or after each use, at step 110. This second plurality includes physiological information related to the user's responses to the workout, such as heart rate, calorie bum rate, and current resistance of the fitness device, and may be collected by seonsors communicatively connected to the fitness device 32.

The automated control location 12 assesses the performance of the user during each use of a plurality of uses, at step 112, based on a comparison of the second plurality of user information to at least a portion of the first plurality (eg. At least one goal, such as a desired weight loss). This assessment is performed by a software performance assessment routine resident on the automated control location 12. The plurality of assessments that result are used to incrementally generate a performance database at the automated control location 12, at step 114. In a preferred embodiment, the performance database is accessible to the user at any point in any workout, thereby allowing the user to perform a comparison of the user's current performance. Further, the performance database may be limited to generation over a fixed number of uses. Based on a comparison of the performance database to the second plurality, a fitness comparator resident at the automated control location may send a plurality of adjustment signals to the fitness device 32, at step 120. These signals may, for example, cause an increase or decrease in the difficulty level of the workout, dependant on whether the user is beyond a goal level, approaching the goal level, beneath a goal level, becoming tired, returning from a layoff, or at an increased risk of injury, as evidenced by the fitness comparator results. In another embodiment, these adjustments may cause variations in environmental factors that affect the user's workout, either consciously or subconsciously. These environmental factors may include the speed of music that accompanies the workout, or the temperature of the room.

The performance assessment of the present invention generally includes numerous calculations based on an energy expenditure necessary to reach at least one of the goals, which energy expenditure is found from the health database. One calculation may be, for example, a division the necessary energy expenditure by an expected time length of the use, thereby generating a percentage of goal reachable by the user. In one embodiment, a new suggested goal is formulated by the automated control location and downloaded to the fitness device for review by the user if the percentage of goal reachable meets a predetermined low at step 122. In such a case, the probability of the user reaching the user's goal is small, so the user may be given the option to adjust the workout and the goal, or the adjustments may be performed automatically, as explained hereinabove.

Where the user elects the automated fitness test mode at step 106, a test is run wherein the user's performance is compared to an industry standard. The industry standard may be included in the health database. The automated fitness test may be performed by the fitness device, or by the automated control location. The automated fitness test mode preferably includes a comparison of the second plurality of user information to the industry standard database at step 130, and a recordation of the results of the comparison at step 132. The results of the automated fitness test mode are preferably incrementally recorded to an automated fitness test database at step 134, and that automated fitness test database is preferably accessible to the user before, during, and after each workout. Information developed during the automated fitness test mode may be uploaded to the automated control location from the fitness device either in real-time or after each use.

In one embodiment of the present invention, a fitness coach is resident on the automated control location 12. The fitness coach provides interactive information and suggested difficulty levels of use to the user at step 140. The interactive information and the suggested difficulties are based on a comparison by the automated control location of the first plurality, the second plurality, and the performance database. The interactive information and suggested difficulties may be used in conjunction with, or separately from the automated adjustments discussed hereinabove, in order to help the user obtain the user's goals. The interactive information may be, for example, an audible comparison of the current workout and at least one prior use. The suggested difficulty level may be, for example, an automated estimation of a necessary difficulty to achieve a goal based on the current use and at least one prior use. Suggestions may be made by the automated remote control location 12 using the fitness coach as to diet and exercise variations which would help the user 34 achieve his goals, and the exercise variations that are suggested may then be made to the fitness device automatically by receipt of the adjustment control signals from the automated remote control location 12. Alternative goals may also be suggested by the remote system 12 based on the comparisons and correlation discussed hereinabove. Finally, the user's exercise routine may be tracked during each session, and other variables, such as diet, may also be tracked between sessions, and this tracked information may compared by the remote system 12 to the information which would allow the user 34 to meet his goals, thereby forming a personalized, permanent record of the user's diet and exercise history. Thus, an interactive virual trainer is provided, without the need for an operator at the remote control location 12.

A fitness equipment interface 22 is provided for coupling the fitness device 32 to the network connection device 18. A communication channel 24 is provided between the fitness device 32 and the fitness equipment interface 22 for transmitting information therebetween. Any suitable open communication language 26 can be used for communicating this information from the controller 28. A safety interface 20 is provided within user location 34 between controller 28 and network connection device 18 for detecting whether a user falls off or the user heart rate goes too high and shutting the treadmill off.

The user location 34 interactively applies and receives the interactive information to the internet system 19 by way of network connection device 18. The network connection device 18 can be a network computer, a personal computer, a cable television box, or any other suitable connection device. The user location information transmitted by way of the network connection device 18 can include personal information identifying or describing the user to the web site 12. For example, in addition to a user password if desired, the user location 34 can provide user information such as user heart rate, weight, age and gender.

Device information such as speed, incline and suspension can also be communicated by the user or automatically by way of the internet system 19. Any other information useful for interaction between the user location 34 and the web site 12 can also be applied to the internet system 19. The user information and the device information can be used by the web site 12, as well as by the controller 28, to calculate, for example, calorie information. Calorie information calculated in this manner can be used to provide control signals for controlling the fitness device 32 according to the calorie information, both in a current exercise session and in a future one. Information within the fitness system 10 can also be interactively communicated to and from third party applications 14. An internet browser 17 can be coupled to the network connection device 18. The internet browser 17 permits the user of fitness system 10 to browse the internet system 19 both during and between exercise sessions.

Figure 2A:
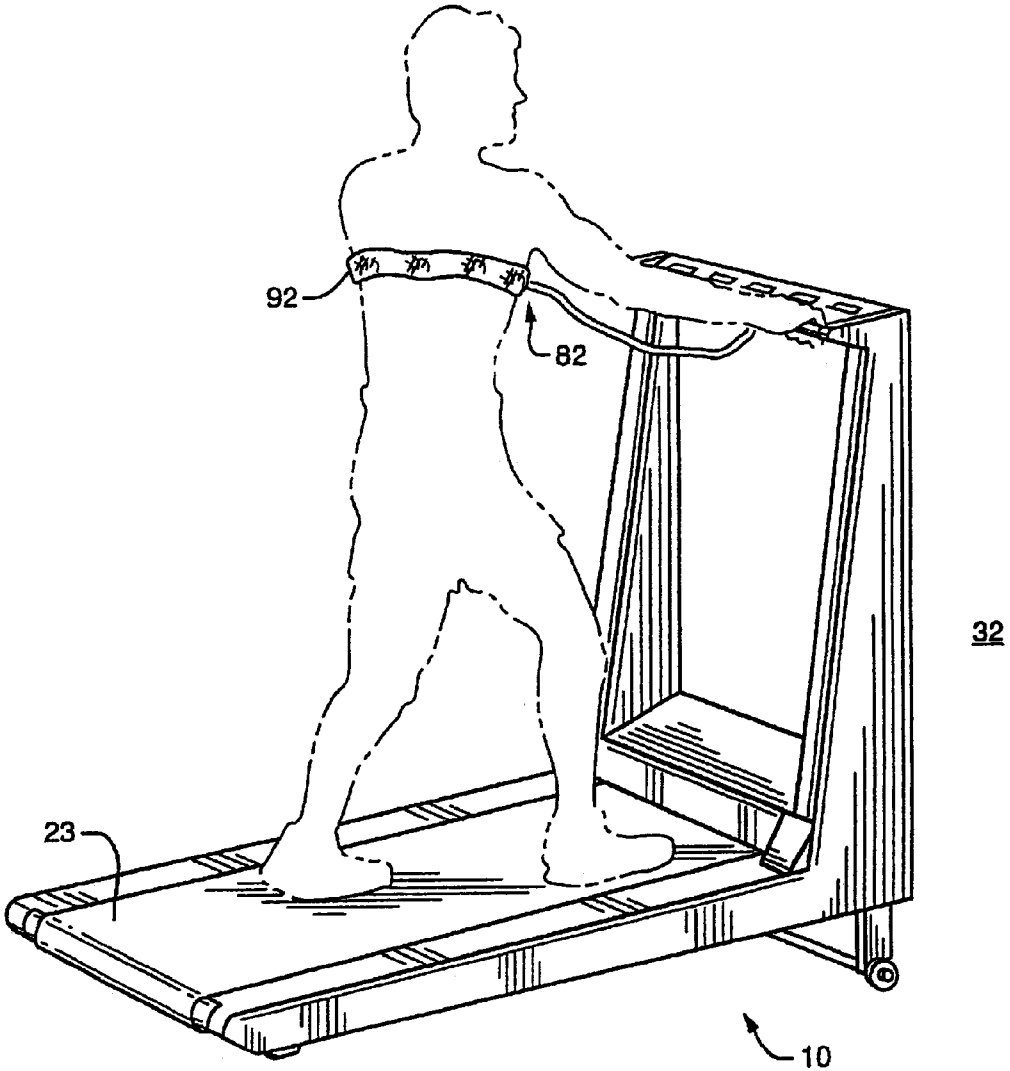
FIGS. 2A–C show perspective views of an exercise device suitable for use within the fitness system of FIG. 1.
Figure 2B:
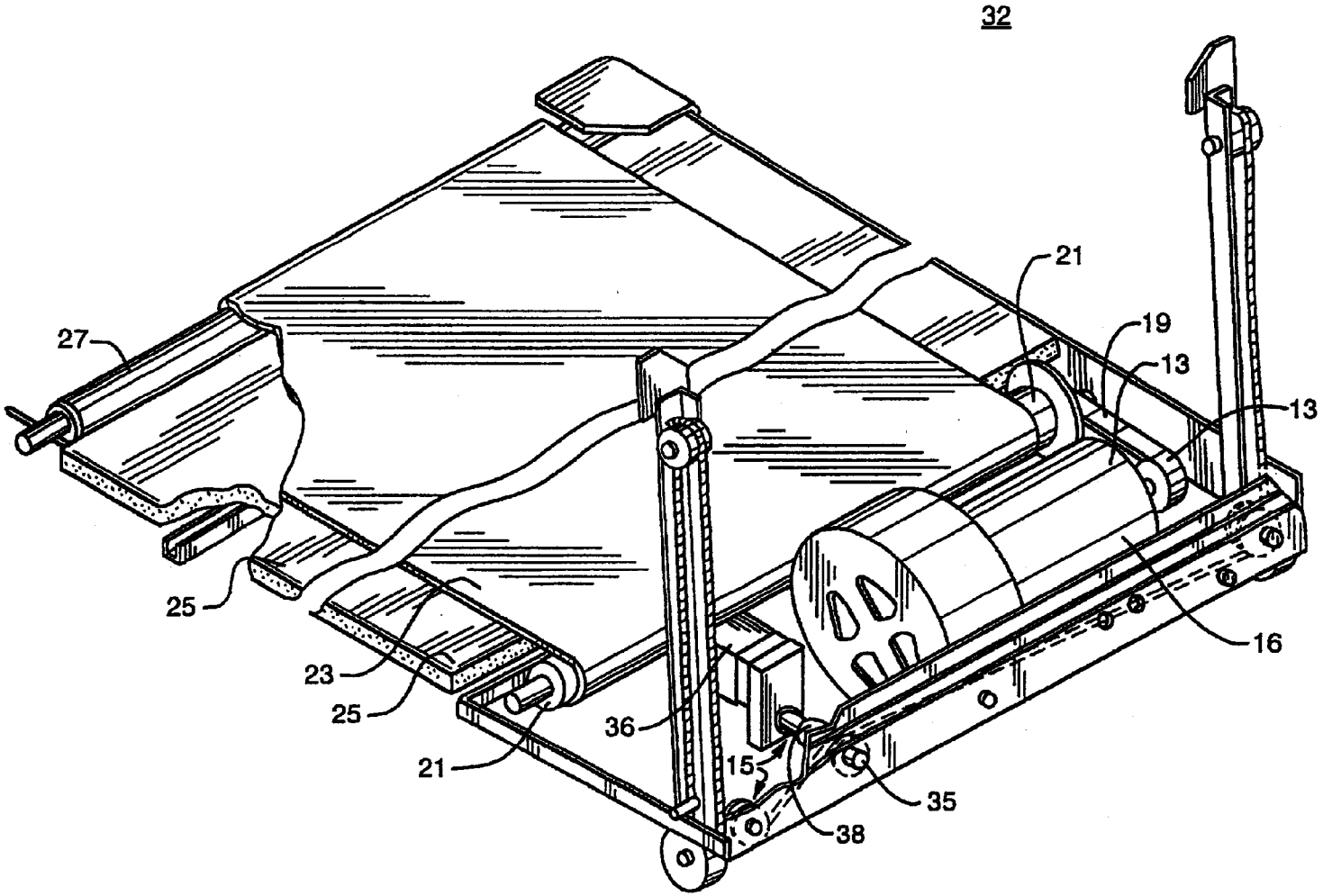
Figure 2C:
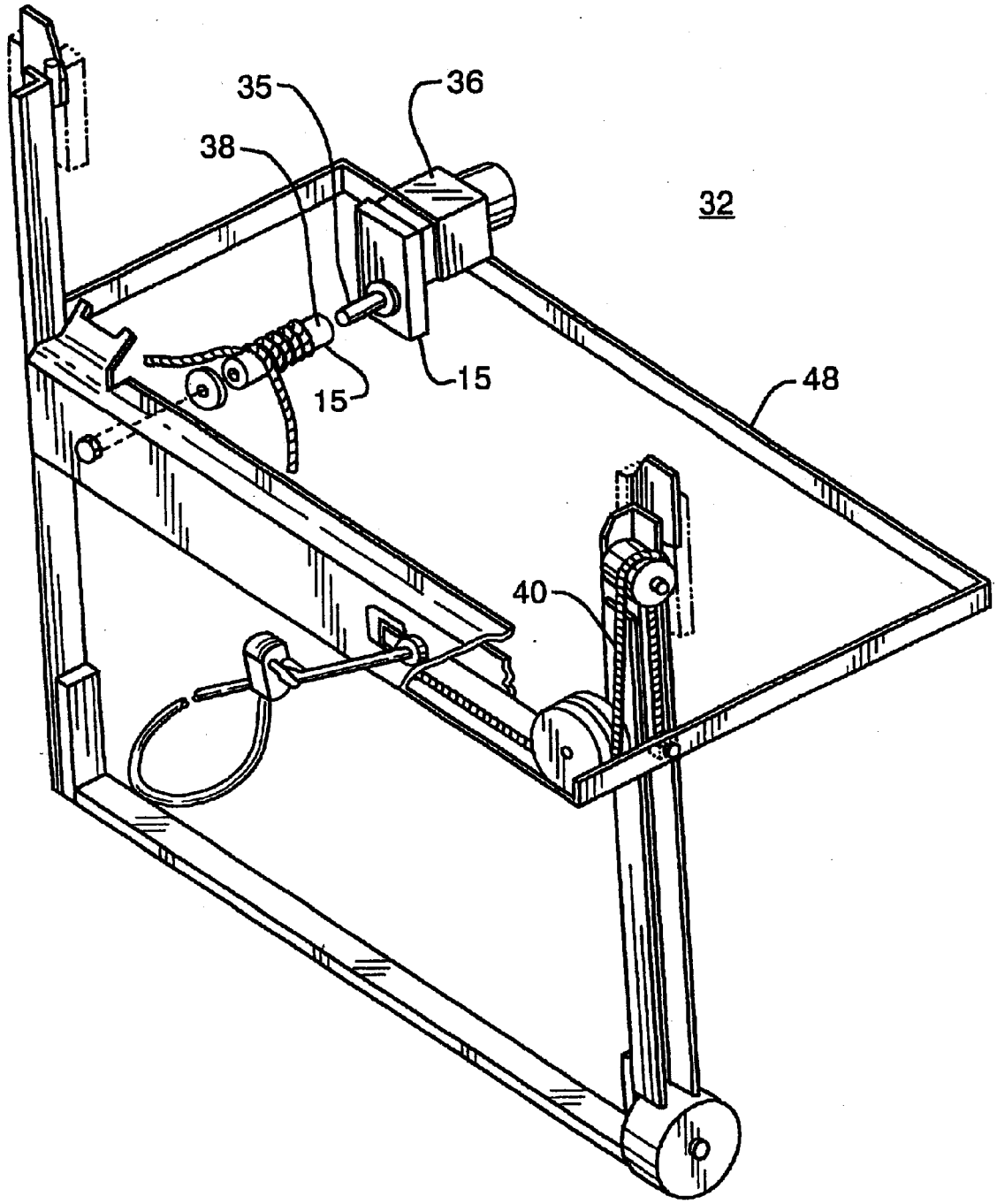

Referring now to FIGS. 2A–C, there is shown an exercise apparatus 32 having a plurality of resistance mechanisms, wherein the exercise equipment 32 is shown as a treadmill. As previously described, it will be understood that the system of the present invention can be applied to any type of exercise equipment. Thus, the fitness device 32 is set forth only as an illustrative example of the type of exercise equipment wherein the present invention can be advantageously applied. Furthermore, the fitness device 32 set forth is only a single example of the many types of treadmills that can be used within the fitness system 10.

In the fitness device 32 the first resistance mechanism 13 is a speed varying mechanism and the second resistance mechanism is a grade adjustment mechanism 15. In order to vary the speed of the fitness device 32, and thus increase the resistance of the first resistance mechanism 13, a variable speed drive motor 16 is mechanically coupled in a conventional manner by a drive belt 19 to a drive roller 21 to rearwardly move a continuous belt 23. The continuous belt 23 is a rotating surface that rides upon a low friction support surface 25. Although a drive belt 19 is shown for coupling the drive roller 21 to the drive motor 16, gears or the like can also be used. A freely rotating rear roller 27 is provided to redirect the continuous belt 23 forwardly beneath the support surface 25 in a conventional manner.

The continuous belt 23 is adapted to prevent slippage on the drive roller 21 under ordinary loads. This can be accomplished by providing proper tensioning, coefficients of friction or by having treads in the underside of the belt 23 to mate with the drive roller 21. Thus, as the drive motor 16 rotates, the belt 23 rotates at a corresponding speed. Preferably, the drive motor 16 is a DC motor, for which the drive signals are voltages of appropriate levels applied to the motor 16 for specified periods of time. The fitness equipment controller 28 can provide one or more signals that determine the resistance level of the first resistance mechanism 13 for controlling the speed of the fitness device 32.

To vary the grade or incline angle of the rotating treadmill surface a conventional motor-driven windlass can be used. This alters the resistance of the second resistance mechanism 15 and alters the amount of exertion required by the user to remain on the apparatus 32. An incline motor 36 is mechanically coupled at its shaft 35 to a drum 38 or cylinder 38 provided for this purpose. The drum 38 is provided with a cable 40 so that rotating the drum 38 winds or unwinds the cable 40 to raise or lower a lift frame 48 as the incline motor 36 is operated.

The incline motor 36 is also controlled by signals from the controller 28. The incline motor 36 can be a stepping motor controlled by controller signals that are pulses. It can also be an AC or DC motor 36 wherein the control signals from the controller 28 cause voltages of appropriate levels to be applied to the incline motor 36 for specified periods of time. For example, a conventional treadmill incline mechanism can be used wherein a control signal activates a relay to apply power to a fractional AC motor until the grade is incremented by the desired amount. In this manner, the controller 28 provides one or more signals that determine the grade of the drive roller 21 and thereby the resistance level of the second resistance mechanism 15. Additionally, a braking system can be provided in the fitness device 32 and the controller 28 can control the braking system using control signals.

In one embodiment of a fitness device 32, the controller 28 can adjust the grade between 0.0 percent (level, or 0.0 degrees) and 16 percent in one half percent increments. The incline motor 36 is preferably a reversible motor of a type that remains locked in position when power is removed so that the cable 40 does not unwind due to gravitational force. Alternatively, mechanical means such as gears, stops and the like may provide the reversibility and locking features.

Figure 3:
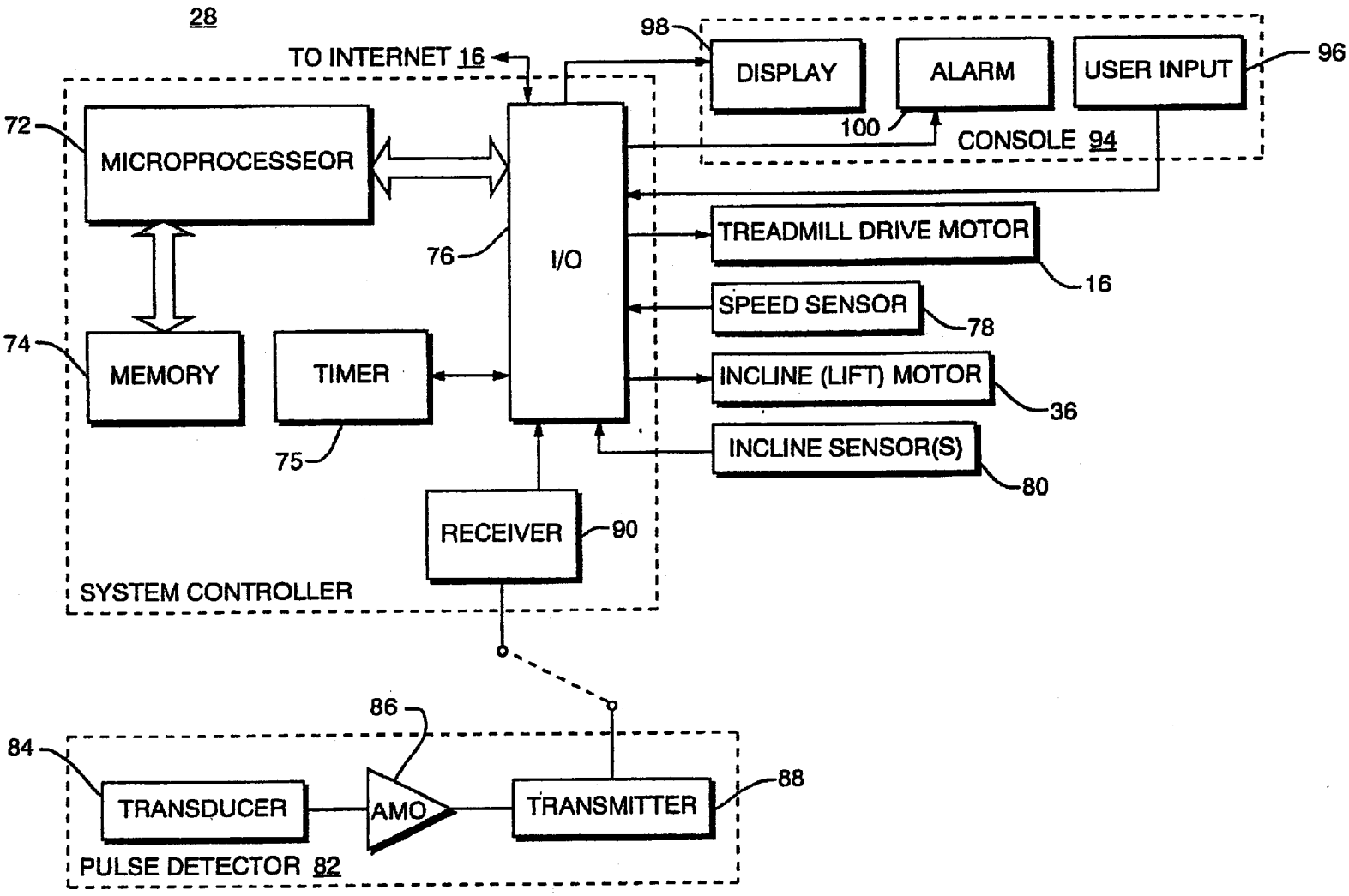
FIG. 3 shows a block diagram representation of a controller suitable for use in the exercise device of FIGS. 2A–C.

Referring now to FIG. 3, there is shown a block diagram representation of an exemplary controller 28 of the programmable fitness device 32. The controller 28 can include a microprocessor 72, a memory 74, a timer 75 and input/output (I/O) circuitry 76 connected in a conventional manner. The memory 74 can include random access memory (RAM), read only memory (ROM), or any other type of storage means. The I/O circuitry 76 can include conventional buffers, drivers, relays and the like, such as for driving the motors 16, 36 with sufficient power. Conventional circuitry for latching output signals from the microprocessor 72 is also ordinarily included in the output circuitry 76. Thus, output signals from the microprocessor 72, interfaced though the output circuitry 76, control the drive motor 16 and incline motor 36.

The output signals of the microprocessor 72 also control the display 98 which can be located on a console 94 of the exercise equipment 32. It will be understood that information representative of the operation of any of the devices included in the controller 28 can be interactively transmitted between the user location 34 and the web site 12 by way of I/O circuitry 76 which is coupled to the internet system 19 by way of interface 22.

Since the speed and grade of the fitness device 32 is determined by the controller 28, the controller 28 normally has all speed and grade information required to the fitness control device 32. However, it is preferable to include a speed sensor for detecting the actual speed of the fitness device 32 and an incline sensor for determining the actual grade. Sensors suitable for this purpose are well known to those skilled in the art. For example, a speed sensor 78 can be a conventional Hall effect type sensor adapted to provide a value to the controller 28 that indicates the revolutions per minute of the drive roller 21. The controller 28 can then convert the value received from speed sensor 78 to miles per hour. The incline sensor 80 can be any conventional sensor suitable for the purpose.

In accordance with one aspect of the invention, the resistance levels of the resistance mechanisms 13, 15 of the fitness device 32 can be varied with respect to one another according to the heart rate of the user. Additionally, the heart rate can be monitored by the controller 28 or the web site 12 for safety reasons. Accordingly, the fitness device pulse detection circuitry 82 secured to the user by a strap 92 detects the user heart rate. A suitable timer, such as a timer 75, is used to determine the rate of the pulse signals received from the detection circuitry 82. Any conventional pulse detection circuitry 82 can be used provided it can supply a signal corresponding to the user heart rate for the input circuitry 76 of the controller 28. The pulse detection circuitry 82 can include an electrocardiograph type detection device that senses electric currents or electrical potentials on the user in order to provide a signal corresponding to the heart rate, or any other type of device that senses user heart rate and provides corresponding signals. The output of a transducer 84 within the pulse detection circuitry 82 can be amplified by an amplifier 86 and transmitted by a transmitter 88 to an I/O receiver 90.

The previous description of the preferred embodiments is provided to enable those skilled in the art to make and use the present invention. The various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein. For example, air pressure at the user location can be monitored and controlled in the manner previously described in the system of the present invention. The air pressure device can, for example, be a bladder, any type of air suspension, or any type of hydraulic system. Additionally, a cooling fan for variably blowing air on a user can be controlled according to the user temperature. The temperature of various components at the user location can also be monitored and controlled.

What is claimed is:

1. A personalized training system, comprising:

a fitness device, wherein a user enters, at the fitness device and before a use of the fitness device by the user, a first plurality of user information, which first plurality includes a choice of an automated interactive learned program mode or an automated fitness test mode;

an automated control location that is remotely connected to the fitness device through a communicative connection, which automated control location receives the first plurality of user information, and a second plurality of user information during each use of the fitness device by the user;

a performance assessor resident at said automated control location, which performance assessor assesses a performance of said user during each use of a plurality of uses, based on a comparison of the second plurality of user information to the first plurality;

a performance database incrementally formed by at least the plurality of performance assessments, resident at said automated control location; and a fitness comparator that adjusts the use based on a comparison of said performance database to the second plurality.

2. The personalized training system of claim 1, wherein said performance database is accessible to the user at the fitness device during each use.

3. The personalized training system of claim 1, wherein said performance database is generated over a fixed number of uses.

4. The personalized training system of claim 1, wherein the first plurality includes at least two goals and at least one parameter.

5. The personalized training system of claim 4, wherein the at least one parameter includes at least one parameter selected from the group consisting of age, weight, sex, height, and medical conditions.

6. The personalized training system of claim 4, wherein the plurality of performance assessment include a calculation of an energy expenditure necessary to reach at least one of the goals.

7. The personalized training system of claim 6, wherein the calculation further includes dividing the necessary energy expenditure by an expected time length of the use, thereby generating a percentage of goal reached.

8. The personalized training system of claim 7, wherein a new suggested goal is formulated by said automated control location and downloaded to the fitness device for review by the user if the percentage of goal reached meets a predetermined low at the automated control location.

9. The personalized training system of claim 1, wherein the second plurality is collected by at least one sensor communicatively connected to the fitness device.

10. The personalized training system of claim 1, wherein the second plurality includes at least two information items selected from the group consisting of heart rate, calorie burn rate, and resistance of the fitness device.

11. The personalized training system of claim 1, wherein the second plurality is uploaded to said automated control location from the fitness device in a time frame selected from the group consisting of realtime and after each use.

12. The personalized training system of claim 1, wherein the automated fitness test mode is performed by the fitness device.

13. The personalized training system of claim 1, wherein the automated fitness test mode is performed by said automated control location.

14. The personalized training system of claim 1, wherein the automated fitness test mode comprises:

a comparison of the second plurality to an industry standard database; and a recording of the comparison.

15. The personalized training system of claim 14, wherein the automated fitness test mode is recorded to an automated fitness test database, which automated fitness test database is accessible to the user.

16. The personalized training system of claim 14, wherein the automated fitness test mode is uploaded to the automated control location from the fitness device in a time frame selected from the group consisting of realtime and after each use.

17. The personalized training system of claim 1, further comprising software resident at said automated control location that performs the plurality of performance assessment.

18. The personalized training system of claim 1, wherein the adjustment comprises increasing or decreasing a difficulty level of the use.

19. The personalized training system of claim 1, wherein the adjustment comprises varying an environmental factor.

20. The personalized training system of claim 19, wherein the environmental factor is at least one selected from the group consisting of music and temperature.

21. The personalized training system of claim 1, further comprising a fitness coach that provides interactive information and suggested difficulties of use to the user, wherein the interactive information and the suggested difficulties are based on an comparison by said automated control location of the first plurality, the second plurality, and the performance database.

22. The personalized training system of claim 21, wherein the interactive information comprises an audible comparison of a current and at least one prior use.

23. The personalized training system of claim 21, wherein the suggested difficulties comprise an automated estimation based on a current use and at least one prior use.

* * * * *